US008462076B2

(12) United States Patent
Fruh

(10) Patent No.: US 8,462,076 B2
(45) Date of Patent: Jun. 11, 2013

(54) ADJUSTABLE MOUNTING ASSEMBLY FOR AN ANTENNA

(75) Inventor: Jason Fruh, Castle Rock, CO (US)

(73) Assignee: EchoStar Technologies, L.L.C., Englewood, CO (US)

( * ) Notice: Subject to any disclaimer, the term of this patent is extended or adjusted under 35 U.S.C. 154(b) by 397 days.

(21) Appl. No.: 12/815,006

(22) Filed: Jun. 14, 2010

(65) Prior Publication Data

US 2011/0304518 A1 Dec. 15, 2011

(51) Int. Cl.
*H01Q 3/02* (2006.01)

(52) U.S. Cl.
USPC ..... 343/882; 343/878; 343/880

(58) Field of Classification Search
USPC ..... 343/878, 880, 882
See application file for complete search history.

(56) References Cited

U.S. PATENT DOCUMENTS 2,667,317 A * 1/1954 Trebules ..... 248/514
4,626,864 A * 12/1986 Micklethwaite ..... 343/766
6,466,181 B1 10/2002 Ho et al.
6,480,172 B1 * 11/2002 Sawyer ..... 343/890
6,873,304 B1 3/2005 Malhotra

OTHER PUBLICATIONS

European Patent Office, International Searching Authority, "International Search Report" mailed Aug. 12, 2011; International Appln. No. PCT/US2011/038117, filed May 26, 2011.

* cited by examiner

*Primary Examiner* — James H Cho
(74) *Attorney, Agent, or Firm* — Ingrassia Fisher & Lorenz, P.C.

(57) ABSTRACT

A mounting assembly for an antenna includes a mounting foot, an antenna mast, and two mast positioning components. The foot includes a base that can be attached to a mounting structure, and two opposing sidewall flanges extending from the base. Each sidewall flange has a respective slot formed therein. The antenna mast has a proximal end pivotally coupled to the foot between the sidewall flanges. The first mast positioning component is coupled between the sidewall flanges, it is movable within the slots, and it provides a first adjustable support structure for the antenna mast. The second mast positioning component is coupled between the sidewall flanges, it is movable within the slots, and it provides a second adjustable support structure for the antenna mast.

19 Claims, 6 Drawing Sheets

ADJUSTABLE MOUNTING ASSEMBLY FOR AN ANTENNA

TECHNICAL FIELD

Embodiments of the subject matter described herein relate generally to mounting hardware, fixtures, and assemblies suitable for use with antennas. More particularly, embodiments of the subject matter relate to an antenna mounting assembly having a convenient and easy-to-manipulate adjustment feature.

BACKGROUND

Direct broadcast satellite (DBS) systems are commonly used as an alternative or supplement to traditional cable distribution systems that deliver television programming to viewers. A typical DBS system includes a relatively small satellite antenna that is located at the viewer site, e.g., a house, an office building, or a library. To optimize reception of satellite signals, the antenna structure is often mounted to a building or structure such as a rooftop, a wall, an awning, a railing of a deck or balcony, a pillar, or the like.

A DBS antenna structure typically includes a mounting foot, a mast, and the antenna assembly itself (which includes the satellite dish component). The mounting foot is attached to the desired mounting structure, and the antenna assembly is attached to the mounting foot using the mast. In typical configurations, the connection between the mast and the mounting foot enables the mast to pivot relative to the mounting foot, which accommodates installation of the antenna structure in a variety of locations and positions. In this regard, it may be desirable to mount the mast and/or the antenna assembly in a certain orientation relative to a vertical reference line (a plumb line). Accordingly, during installation of the antenna structure, the mast can be pivoted and adjusted into the desired position and then secured in that position.

Depending upon the specific design of the mast and mounting foot, adjustment of the mast into the desired position can be difficult and time consuming. Indeed, it may be necessary to involve two or more people to accurately adjust and secure the mast into the desired position. Moreover, in some conventional designs the mast-to-foot joint is subjected to high torque (due to the length of the mast and the mass of the antenna assembly at the end of the mast), which increases under high wind conditions. Consequently, even if the mast is initially secured to the mounting foot in a proper manner, the mast could still "slip" and pivot relative to the mounting foot, especially if the antenna assembly is bumped or if the antenna assembly is exposed to high wind conditions.

Accordingly, it is desirable to have an adjustable antenna mounting assembly that is easy to adjust and install in the field, that is robust and remains in the desired position after deployment, and that otherwise addresses the various shortcomings of conventional antenna mounting assemblies.

BRIEF SUMMARY

An embodiment of a foot assembly for mounting an antenna is provided here. The foot assembly generally includes a foot, a first positioning component, and a second positioning component. The foot includes a base designed to be attached to a mounting structure, a first sidewall flange extending from the base and terminating at a first distal section, a first slot formed within the first distal section, a second sidewall flange extending from the base and terminating at a second distal section (the second sidewall flange opposing the first sidewall flange), and a second slot formed within the second distal section (the second slot opposing and aligned with the first slot). The first positioning component extends between the first sidewall flange and the second sidewall flange, the first positioning component is slidably adjustable within the first slot and the second slot, and the first positioning component provides a first support structure for an antenna mast. The second positioning component extends between the first sidewall flange and the second sidewall flange, the second positioning component is slidably adjustable within the first slot and the second slot, and the second positioning component provides a second support structure for the antenna mast.

Also provided is another embodiment of a foot assembly for mounting an antenna mast. The foot assembly includes a foot, a first positioning component, a second positioning component, and an adjustment assembly. The foot includes: a first sidewall flange terminating at a first distal section; a first slot formed within the first distal section; a second sidewall flange terminating at a second distal section, the second sidewall flange opposing the first sidewall flange; and a second slot formed within the second distal section, the second slot opposing and aligned with the first slot. The first positioning component is coupled between the first sidewall flange and the second sidewall flange, it is configured for sliding movement within the first slot and the second slot, and it is configured to bear upon a first external side of the antenna mast. The second positioning component is coupled between the first sidewall flange and the second sidewall flange, it is configured for sliding movement within the first slot and the second slot, and it is configured to bear upon a second external side of the antenna mast. The adjustment assembly is to the first positioning component and the second positioning component, and it is configured to adjust spacing between the first positioning component and the second positioning component.

An embodiment of a mounting assembly for an antenna is also provided. The mounting assembly includes: a foot; an antenna mast; a first mast positioning component; and a second mast positioning component. The foot includes: a base configured to be attached to a mounting structure; a first sidewall flange extending from the base, the first sidewall flange having a first slot formed therein; and a second sidewall flange extending from the base, the second sidewall flange opposing the first sidewall flange and having a second slot formed therein. The antenna mast has a proximal end pivotally coupled to the foot between the first sidewall flange and the second sidewall flange. The first mast positioning component is coupled between the first sidewall flange and the second sidewall flange, it is movable within the first slot and the second slot, and it provides a first adjustable support structure for a first external side of the antenna mast. The second mast positioning component is coupled between the first sidewall flange and the second sidewall flange, it is movable within the first slot and the second slot, and it provides a second adjustable support structure for a second external side of the antenna mast.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
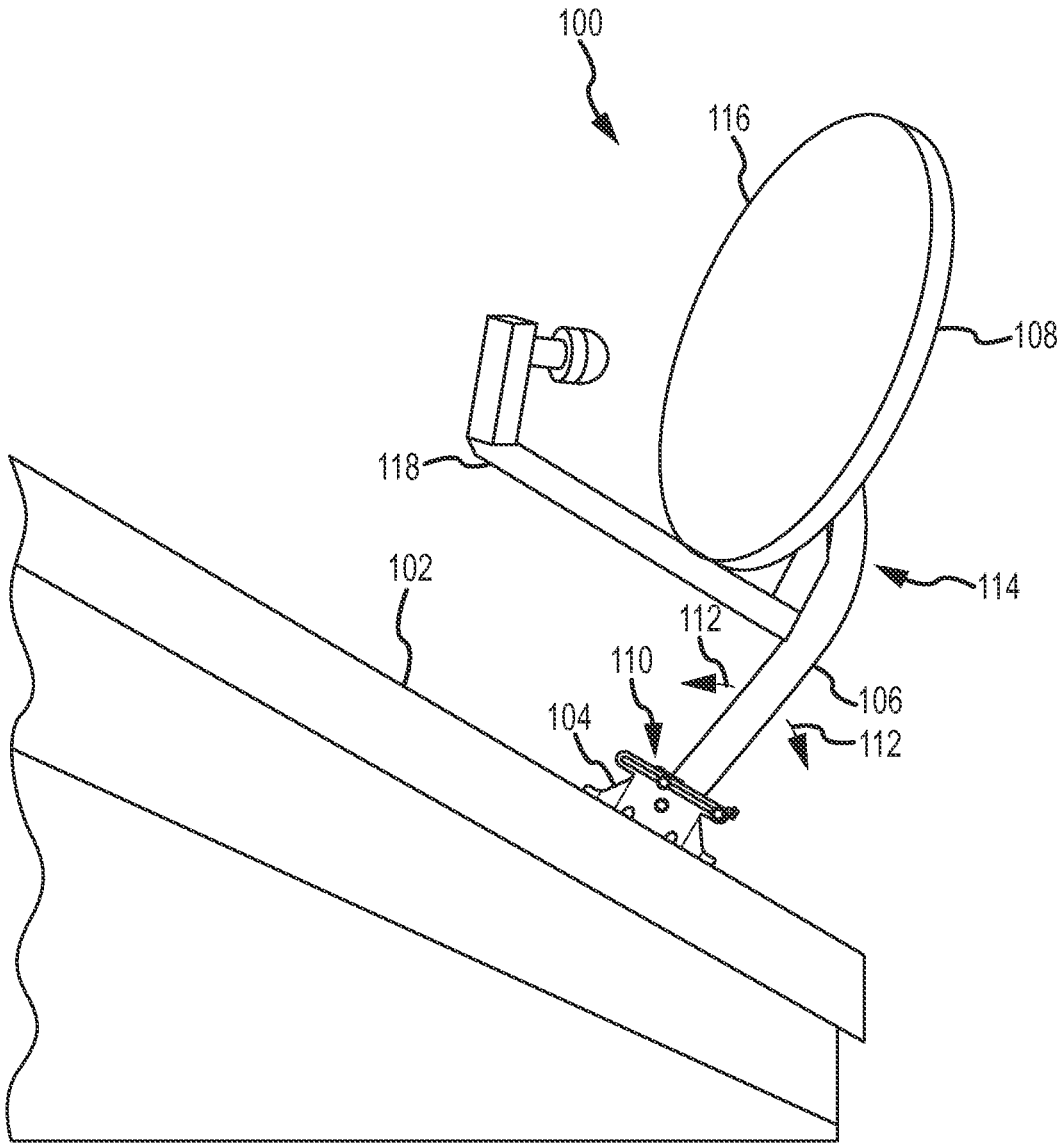
FIG. 1 is a perspective view of an embodiment of an antenna assembly mounted to a rooftop.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

In addition, certain terminology may also be used in the following description for the purpose of reference only, and thus are not intended to be limiting. For example, terms such as "upper", "lower", "above", and "below" might refer to directions in the drawings to which reference is made. Terms such as "front", "back", "rear", "side", "outboard", and "inboard" may be used to describe the orientation and/or location of portions of a component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

FIG. 1 is a perspective view of an embodiment of an antenna assembly 100 mounted to a rooftop 102. The antenna assembly 100 generally includes, without limitation: a mounting foot assembly 104; an antenna mast 106; and an antenna 108. The mounting foot assembly 104 is attached to the rooftop 102, which represents a suitable mounting structure for the antenna assembly 100. The antenna mast 106 has a proximal end 110 that is pivotally coupled to the mounting foot assembly 104 in the manner described in more detail below. This pivoting joint facilitates adjustment of the angle of the antenna mast 106 relative to the mounting foot assembly 104. Although the mounting foot assembly 104 and the antenna mast 106 could be suitably configured to pivot, rotate, and/or swivel in any number of directions, the embodiment described here accommodates pivoting of the antenna mast 106 substantially in one plane (as indicated by the arrows 112 in FIG. 1).

The antenna mast 106 has a distal end 114 to which the antenna 108 is coupled. In some embodiments, the antenna 108 is coupled to the antenna mast 106 such that the antenna 108 can pivot, rotate, swivel, or be otherwise adjusted relative to the distal end 114 of the antenna mast 106. The antenna 108 may include one or more components assembled together, e.g., a dish 116 and a low noise block feed 118. The antenna 108 is typically installed onto the antenna mast 106 after the mounting foot assembly 104 has been attached to the mounting structure (the rooftop 102 in this example) and after the antenna mast 106 has been adjusted and secured in the desired position. In this regard, the adjustment capabilities of the mounting foot assembly 104 allow the installer to adjust (pivot) the antenna mast 106 relative to the mounting foot assembly 104, and thereafter secure and fix the antenna mast 106 in the desired position.

Figure 2:
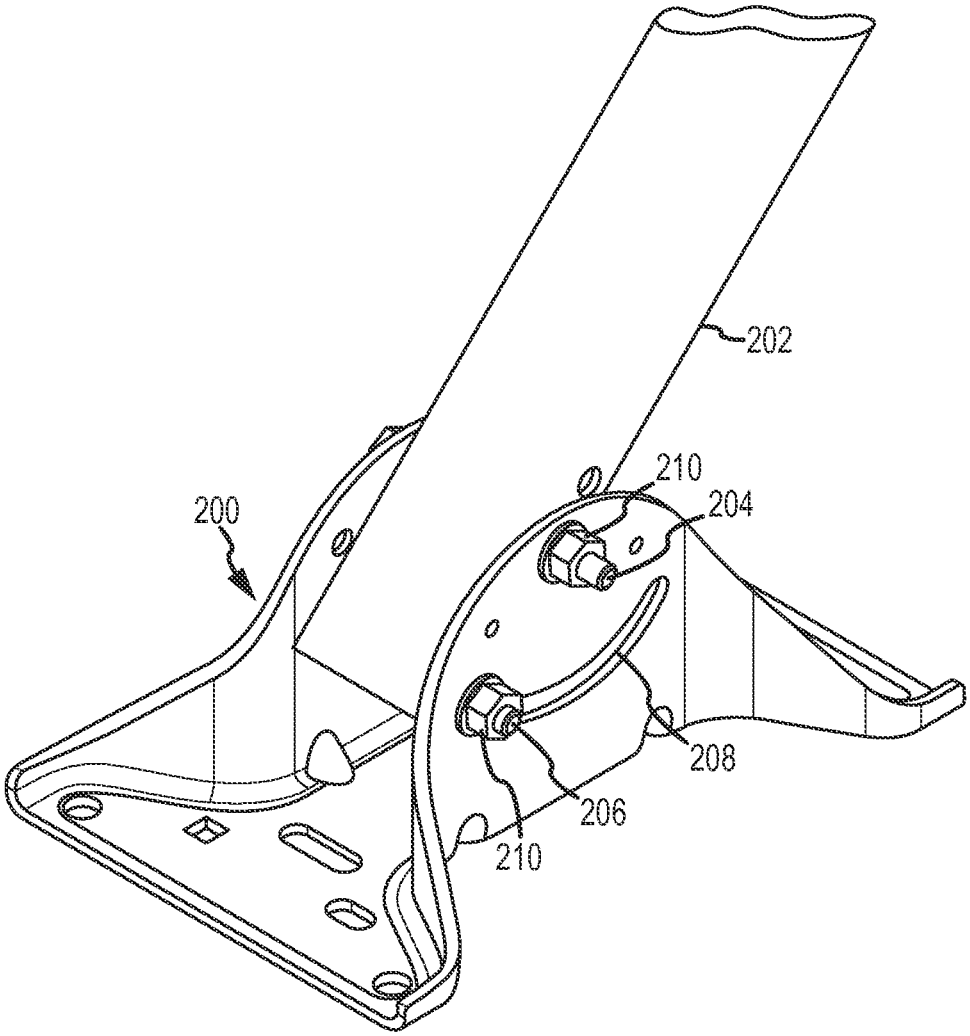
FIG.2 PRIOR ART
FIG. 2 is a perspective view of a mounting foot and an antenna mast of a conventional antenna assembly.

FIG. 2 is a perspective view of a mounting foot assembly 200 and an antenna mast 202 of a conventional antenna assembly. The antenna mast 202 is coupled to the mounting foot assembly 200 using one through bolt 204 and two carriage bolts 206 (only one of which is visible in FIG. 2). The through bolt 204 corresponds to the axis of rotation of the antenna mast 202 relative to the mounting foot assembly 200. The carriage bolts 206 are inserted through two C-shaped slots 208 (only one of which is visible in FIG. 2) and through a corresponding hole located at the end of the antenna mast 202. This arrangement allows the antenna mast 202 to pivot about the upper through bolt 204 throughout the range defined by the slots 208. Thus, a technician can manipulate the antenna mast 202 into the desired position and tighten the nuts 210 to "lock" the antenna mast 202 in place. Notably, the antenna mast 202 is held in place by the friction and force imparted against the antenna mast 202. In other words, the through bolt 204 and the carriage bolts 206 are tightened such that flanges of the mounting foot assembly 200 squeeze the sides of the antenna mast 202. Although this adjustment feature is simple and effective, adjustment of the antenna mast 202 can be cumbersome and time consuming. Moreover, the antenna mast 202 might shift if one or both nuts 210 become loose and/or if the antenna (not shown in FIG. 2) is subjected to high wind conditions.

The antenna assembly described in more detail below employs an improved mast adjustment feature that makes it easier for an installer to adjust and secure the antenna mast in the desired position relative to the mounting foot assembly. Moreover, certain embodiments of the antenna assembly described here utilize a "fine adjustment" mechanism for the antenna mast. The mounting foot assembly presented here is suitably configured to maintain the antenna mast in the desired position even under high wind conditions. As described in more detail below, the mounting foot assembly does not solely rely on friction and compressive force to hold the antenna mast in place.

Figure 3:
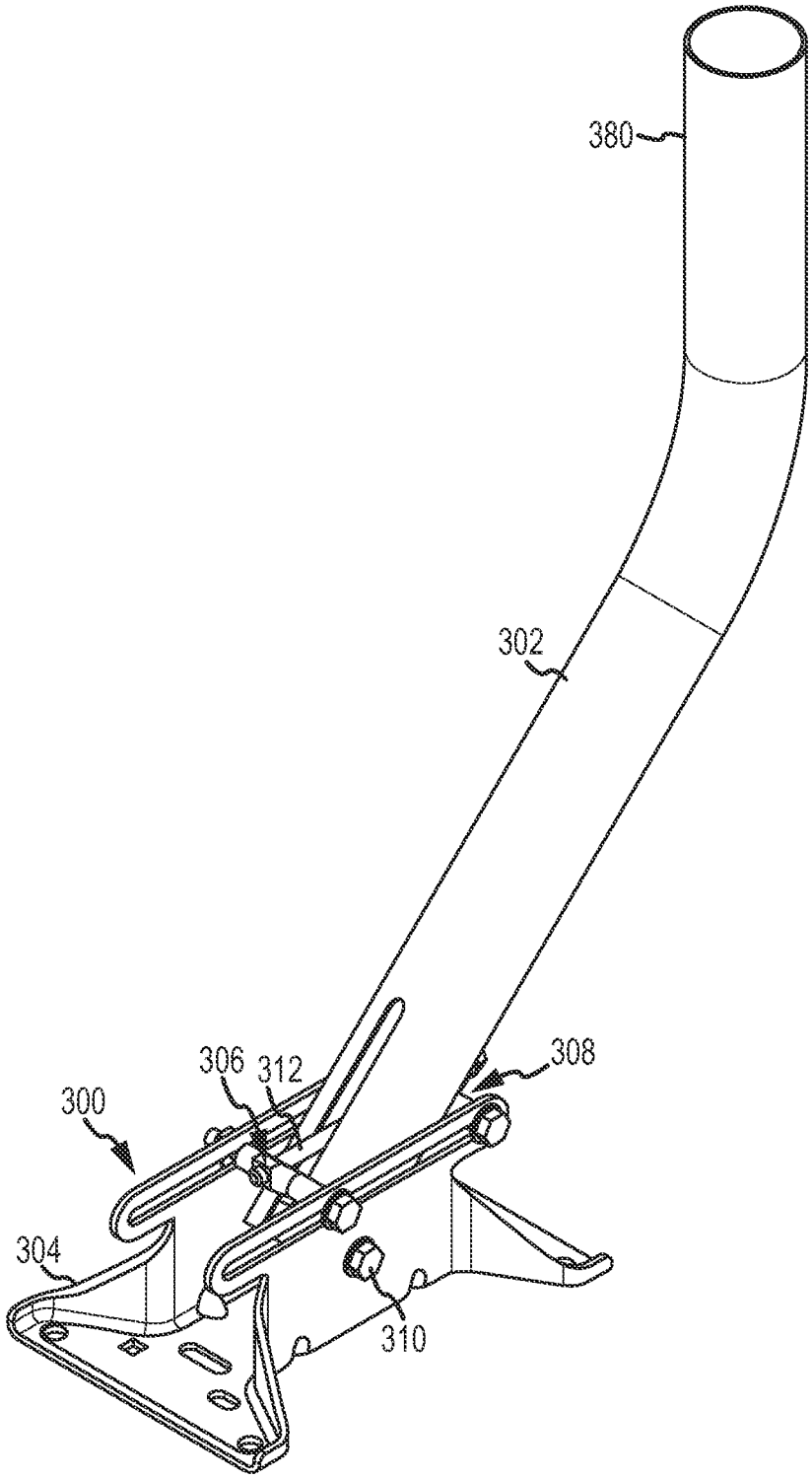
FIG. 3 is a perspective view of a mounting foot assembly and an antenna mast configured in accordance with an exemplary embodiment.
Figure 4:
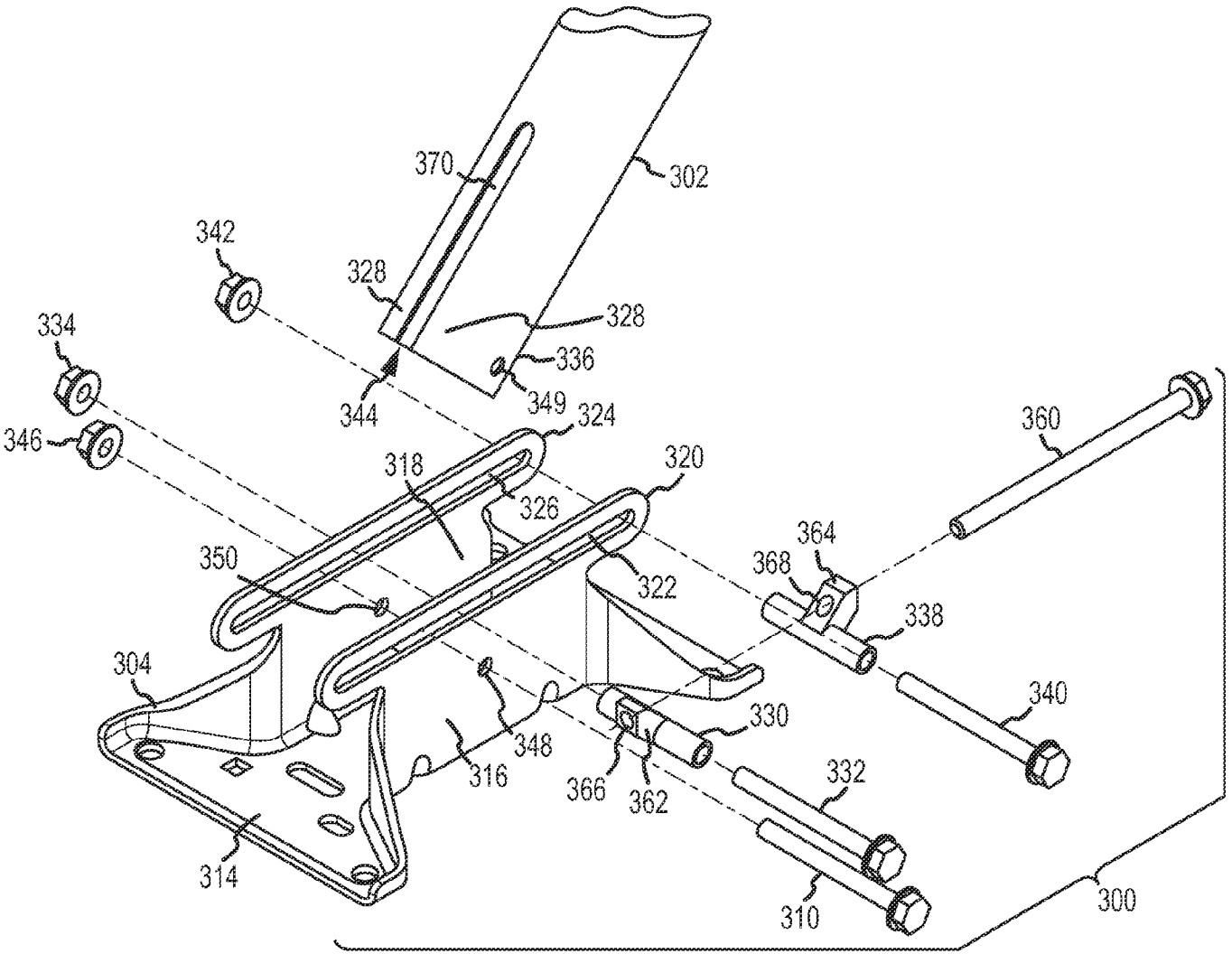
FIG. 4 is an exploded perspective view of the mounting foot assembly shown in FIG. 3.
Figure 5:
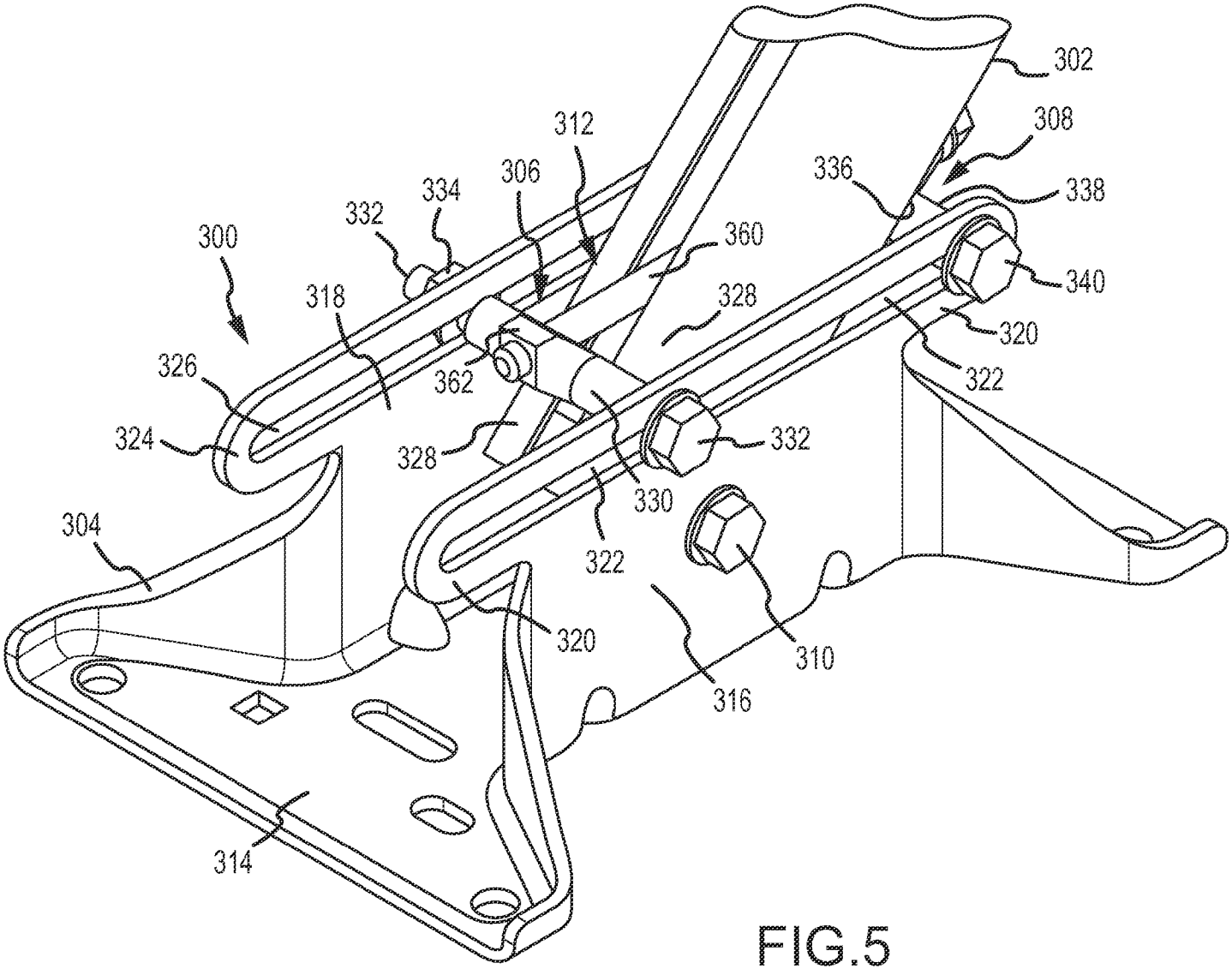
FIG. 5 is a perspective view of the mounting foot assembly shown in FIG. 3.
Figure 6:
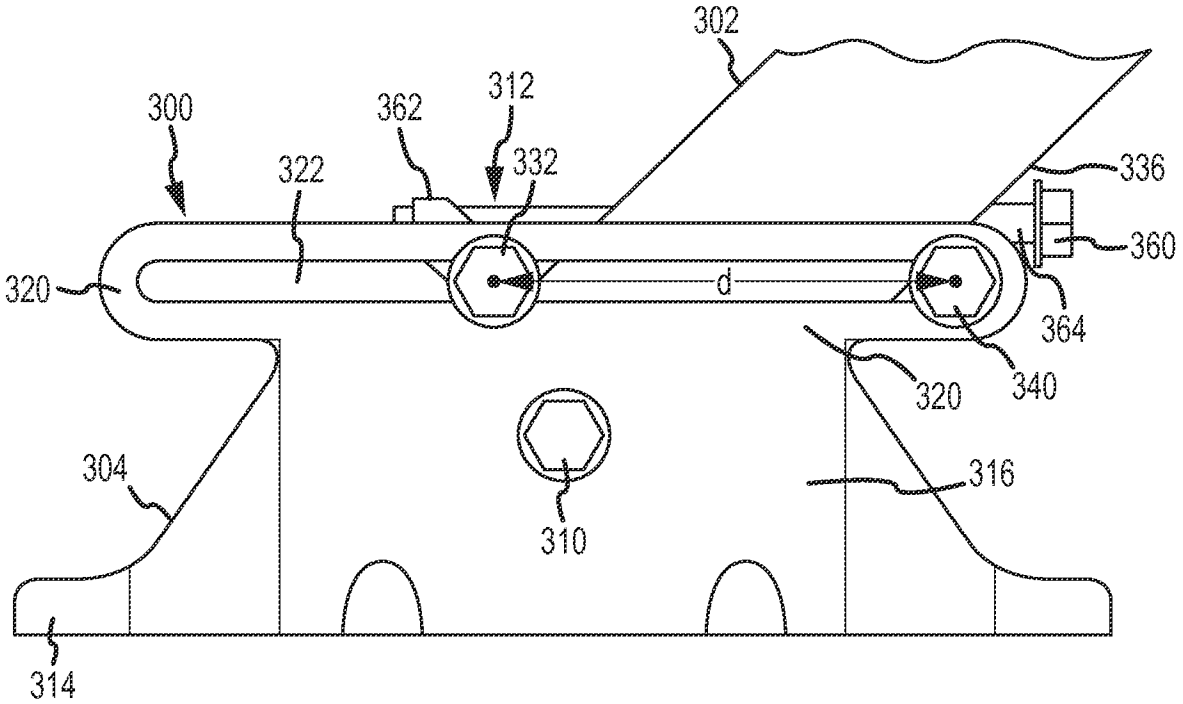
FIG. 6 is a side view of the mounting foot assembly shown in FIG. 3.

FIG. 3 is a perspective view of a mounting foot assembly 300 and an antenna mast 302 configured in accordance with an exemplary embodiment, FIG. 4 is an exploded perspective view of the mounting foot assembly 300, FIG. 5 is an enlarged perspective view of the mounting foot assembly 300, and FIG. 6 is a side view of the mounting foot assembly 300. The combination of the mounting foot assembly 300 and the antenna mast 302 may be referred to herein as a "mounting assembly" for an antenna (not shown in FIGS. 3-6). As explained previously with reference to FIG. 1, an antenna can be coupled to the antenna mast 302 in a conventional manner if so desired.

The illustrated embodiment of the mounting foot assembly 300 generally includes, without limitation: a foot 304; a front positioning component 306; a rear positioning component 308; a coupling element 310; and an adjustment assembly 312. The foot 304 is formed from a strong, tough, and rigid material such as metal, a composite material, reinforced plastic, or the like. In certain embodiments, the foot 304 is fabricated as a one-piece integrated component having the desired shape, features, mounting holes, physical properties, and characteristics. For example, the foot 304 may be formed as a stamped metal (e.g., stainless steel) component, a forged metal component, a machined metal component, or a molded composite component.

Referring to FIGS. 4-6, the foot 304 includes, without limitation: a base 314; a first sidewall flange 316 extending from the base 314; and a second sidewall flange 318 extending from the base 314. Although not always required, the base 314 is typically flat to accommodate easy attachment to a flat mounting structure such as a rooftop, a deck, a wall, or the like. Alternatively, the base 314 could be curved or otherwise contoured to facilitate attachment to mounting structures that are not flat. The first sidewall flange 316 terminates at a respective distal section 320 having a first slot 322 formed therein, and the second sidewall flange 318 terminates at a respective distal section 324 having a second slot 326 formed therein. Although not always required, the sidewall flanges 316, 318 are generally planar and parallel to one another. Accordingly, the sidewall flanges 316, 318 oppose one another and are spaced apart to accommodate the antenna mast 302 therebetween.

The slots 322, 326 oppose one another and are preferably aligned with one another. In other words, when viewed from the side, the slots 322, 326 correspond to one another, as depicted in FIG. 6. For this particular embodiment, the slots 322, 326 are straight (rather than curved) and are parallel to the major plane defined by the base 314. The longitudinal dimension or length of the slots 322, 326 is selected to accommodate the desired angular adjustment range of the antenna mast 302. For this particular example, the distal sections 320, 324 extend (in the fore and aft directions) beyond the major surfaces defined by the respective sidewall flanges 316, 318, as best shown in FIG. 6. These extended distal sections 320, 324 accommodate the desired length of the slots 322, 326, which is slightly less than the fore-aft length of the base 314.

The front positioning component 306 is coupled between the sidewall flanges 316, 318, and it is slidably adjustable within the slots 322, 326. The front positioning component 306 provides a front support structure for the antenna mast 302, and the front positioning component 306 is configured for sliding movement within the slots 322, 326 to accommodate angular adjustment of the antenna mast 302. As shown in FIG. 5, at least one element of the front positioning component 306 contacts, bears upon, or rests against the front or forward-facing external side 328 of the antenna mast 302. Notably, if the adjustable front positioning component 306 is locked in the position shown in FIG. 5 and FIG. 6, it will inhibit or impede forward pivoting of the antenna mast 302.

Although not always required, the illustrated embodiment of the front positioning component 306 includes, without limitation: a sleeve bushing 330; a bolt 332; and a nut 334 (see FIG. 4). The bolt 332 is inserted through the slot 322, through the sleeve bushing 330 (which is located between the sidewall flanges 316, 318), and through the slot 326. At least the end of the bolt 332 is threaded to accommodate the nut 334, which engages the threaded end of the bolt 332. Thus, the nut 334 can be loosened to enable the front positioning component 306 to slide within the slots 322, 326, and the nut 334 can be tightened to secure and fix the front positioning component 306 in its desired fore-aft position on the foot assembly 300.

The sleeve bushing 330 is fabricated from a strong, rigid, and tough material, such as metal. In certain embodiments, the sleeve bushing 330 is formed as a steel casting. Notably, the sleeve bushing 330 is sized such that its length (along its major longitudinal axis) is equal to or slightly less than the outer width of the antenna mast 302. This sizing is desirable to inhibit inward deflection of the sidewall flanges 316, 318 during installation, such that the antenna mast 302 does not get severely bent or crushed when the nut 334 is tightened.

The rear positioning component 308 is also coupled between the sidewall flanges 316, 318, and it is slidably adjustable within the slots 322, 326. The rear positioning component 308 provides a rear support structure for the antenna mast 302, and the rear positioning component 308 is configured for sliding movement within the slots 322, 326 to accommodate angular adjustment of the antenna mast 302. As shown in FIG. 5, at least one element of the rear positioning component 308 contacts, bears upon, or rests against the rear or backward-facing external side 336 of the antenna mast 302. Notably, if the adjustable rear positioning component 308 is locked in the position shown in FIG. 5 and FIG. 6, it will inhibit or impede backward pivoting of the antenna mast 302.

Although not always required, the illustrated embodiment of the rear positioning component 308 includes, without limitation: a sleeve bushing 338; a bolt 340; and a nut 342 (see FIG. 4). The bolt 340 is inserted through the slot 322, through the sleeve bushing 338 (which is located between the sidewall flanges 316, 318), and through the slot 326. At least the end of the bolt 340 is threaded to accommodate the nut 342, which engages the threaded end of the bolt 340. Thus, the nut 342 can be loosened to enable the rear positioning component 308 to slide within the slots 322, 326, and the nut 342 can be tightened to secure and fix the rear positioning component 308 in its desired fore-aft position on the foot assembly 300.

The sleeve bushing 338 is fabricated from a strong, rigid, and tough material, such as metal. In certain embodiments, the sleeve bushing 338 is formed as a steel casting. Notably, the sleeve bushing 338 is sized such that its length (along its major longitudinal axis) is equal to or slightly less than the outer width of the antenna mast 302. This sizing is desirable to inhibit inward deflection of the sidewall flanges 316, 318 during installation, such that the antenna mast 302 does not get severely bent or crushed when the nut 342 is tightened.

The coupling element 310 is used to couple the proximal end 344 of the antenna mast 302 (see FIG. 4) to the foot 304 such that the antenna mast 302 is pivotable relative to the foot 304. Thus, the coupling element 310 corresponds to the axis of rotation of the antenna mast 302 relative to the foot 304. Although not always required, the coupling element 310 in this particular embodiment is realized as a bolt (or other suitable fastener) that extends between the two sidewall flanges 316, 318. In this regard, the mounting foot assembly 300 may include a nut 346 that can be threadably coupled to the coupling element 310. The coupling element 310 is inserted through a first hole 348 formed within the first sidewall flange 316, through two holes 349 (only one of which is visible in FIG. 4) formed in the proximal end 344 of the antenna mast 302, and through a second hole 350 formed within the second sidewall flange 318. As shown in FIG. 5, the antenna mast 302 is positioned between the sidewall flanges 316, 318 before the coupling element 310 is installed.

As depicted in FIG. 5 and FIG. 6, the front positioning component 306 and the rear positioning component 308 are designed to flank the antenna mast 302 to hold the antenna mast 302 in position relative to the foot 304. In this regard, the front positioning component 306 and the rear positioning component 308 are slidably adjustable relative to each other to define a mast adjustment distance therebetween. Although the mast adjustment distance can be taken between any two reference points, FIG. 6 shows a distance (d) defined between the longitudinal centers of the bolts 332, 340. It should be appreciated that this mast adjustment distance (or the spacing between the front positioning component 306 and the rear positioning component 308) corresponds to or otherwise influences the mounting angle of the antenna mast 302 relative to the base 314 of the foot 304. Thus, if the antenna mast 302 depicted in FIG. 6 is to be pivoted forward (i.e., closer to forming a ninety degree angle with the base 314), then the front positioning component 306 and the rear positioning component 308 will be loosened to accommodate forward pivoting of the antenna mast 302. Thereafter, the front positioning component 306 and the rear positioning component 308 will be moved closer together to reduce the mast adjustment distance. Thereafter, the front positioning component 306 and the rear positioning component 308 will be tightened to hold the antenna mast 302 in its new position.

As explained above, the location of the positioning components 306, 308 can be selected in accordance with the desired angular orientation of the antenna mast 302. In practice, the positioning components 306, 308 could be manually positioned and secured. The adjustment assembly 312 (which is a preferred, but optional, feature of the mounting foot assembly 300) can be used as a "fine adjustment" mechanism for the antenna mast 302. The adjustment assembly 312 includes one or more elements that are coupled to the front positioning component 306 and to the rear positioning component 308, and actuation or manipulation of the adjustment assembly 312 changes the spacing between the front positioning component 306 and the rear positioning component 308.

For the illustrated embodiment, the adjustment assembly 312 includes, without limitation: an adjustment bolt 360; a front boss 362 or other suitably configured structure coupled to or integrated with the front sleeve bushing 330; and a rear boss 364 or other suitably configured structure coupled to or integrated with the rear sleeve bushing 338. The front boss 362 has a threaded through hole 366 formed therein, and the rear boss 364 has an unthreaded through hole 368 formed therein. This arrangement accommodates coupling of the adjustment bolt 360 (and/or the adjustment assembly 312 itself) to the sleeve bushings 330, 338. As shown in FIG. 5 and FIG. 6, the major longitudinal axis of the sleeve bushing 330 is orthogonal to the adjustment bolt 360, and the major longitudinal axis of the sleeve bushing 338 is orthogonal to the adjustment bolt 360. This arrangement facilitates easy and efficient adjustment of the positioning components 306, 308 within the slots 322, 326, which are parallel to the adjustment bolt 360.

The threaded through hole 366 has threads that mate with corresponding threads of the adjustment bolt 360. When the mounting foot assembly 300 is assembled, the adjustment bolt 360 is positioned in the unthreaded through hole 368 and is engaged with the threaded through hole 366 (see FIG. 6). The adjustment bolt 360 passes through two slots 370 formed in the proximal end 344 of the antenna mast 302 (only one slot 370 is visible in FIG. 4). Rotation of the adjustment bolt 360 in the clockwise direction (i.e., "tightening") decreases the spacing between the positioning components 306, 308, due to the threaded engagement with the front boss 362. In contrast, rotation of the adjustment bolt 360 in the counterclockwise direction (i.e., "loosening") increases the spacing between the positioning components 306, 308.

It should be appreciated that the adjustment assembly 312 could be designed in an alternate manner while preserving its adjustment capabilities. For example, both the front boss 362 and the rear boss 364 could be threaded (in opposite directions) such that rotation of the adjustment bolt 360 results in movement of both sleeve bushings 330, 338 relative to the adjustment bolt 360. As another example, two or more separate and distinct adjustment bolts (or other actuators) could be deployed to adjust the sleeve bushings 330, 338. As yet another example, another "level" of positioning components and corresponding slots could be deployed above and/or below the positioning components 306, 308 to enhance the structural integrity of the mounting foot assembly 300.

In the field, an antenna assembly can be installed using the mounting foot assembly 300 in the following manner. After the desired location of the antenna assembly has been determined, the mounting foot assembly 300 is attached to the mounting structure via the foot 304. Referring to FIG. 3, in most installations it is desirable to have the straight distal end 380 of the antenna mast 302 as close to plumb (vertical) as possible. Thus, the installer will adjust the angle of the antenna mast 302 as needed until the distal end 380 is approximately vertical. The positioning components 306, 308 can then be partially tightened such that the antenna mast 302 does not move on its own accord. Thereafter, the installer can "fine tune" the angle of the antenna mast 302 by actuating the adjustment bolt 360 while manipulating the antenna mast 302 if necessary. After adjusting the position of the antenna mast 302, the positioning components 306, 308 are completely tightened to secure them and "lock" the antenna mast 302 in position. Thereafter, the remainder of the antenna assembly can be attached to the distal end 380 of the antenna mast 302, and installation can be completed in a conventional manner.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A foot assembly for mounting an antenna, the foot assembly comprising:

a foot comprising:

a base configured to be attached to a mounting structure;

a first sidewall flange extending from the base and terminating at a first distal section;

a first slot formed within the first distal section;

a second sidewall flange extending from the base and terminating at a second distal section, the second sidewall flange opposing the first sidewall flange; and a second slot formed within the second distal section, the second slot opposing and aligned with the first slot;

a first positioning component extending between the first sidewall flange and the second sidewall flange, the first positioning component being slidably adjustable within the first slot and the second slot, and the first positioning component providing a first support structure for an antenna mast;

a second positioning component extending between the first sidewall flange and the second sidewall flange, the second positioning component being slidably adjustable within the first slot and the second slot, and the second positioning component providing a second support structure for the antenna mast; and an adjustment assembly coupled to the first positioning component and the second positioning component, the adjustment assembly configured to adjust spacing between the first positioning component and the second positioning component.

2. The foot assembly of claim 1, wherein:

the first positioning component and the second positioning component are configured to flank the antenna mast;

the first positioning component and the second positioning component are slidably adjustable relative to each other to define a mast adjustment distance therebetween; and the mast adjustment distance influences a mounting angle of the antenna mast relative to the base of the foot.

3. The foot assembly of claim 1, wherein the foot is a one-piece integrated component.

4. The foot assembly of claim 3, wherein the foot is a stamped metal component.

5. The foot assembly of claim 1, further comprising a coupling element extending between the first sidewall flange and the second sidewall flange, the coupling element configured to couple a proximal end of the antenna mast to the foot such that the antenna mast is pivotable relative to the foot.

6. The foot assembly of claim 1, wherein the first sidewall flange and the second sidewall flange are spaced apart to accommodate the antenna mast therebetween.

7. The foot assembly of claim 1, wherein:

the first positioning component comprises a first bolt inserted through the first slot and the second slot; and the second positioning component comprises a second bolt inserted through the first slot and the second slot.

8. The foot assembly of claim 7, wherein:

the first positioning component comprises a first sleeve bushing located between the first sidewall flange and the second sidewall flange, the first bolt inserted through the first sleeve bushing; and the second positioning component comprises a second sleeve bushing located between the first sidewall flange and the second sidewall flange, the second bolt inserted through the second sleeve bushing.

9. The foot assembly of claim 7, wherein:

the first positioning component comprises a first nut that engages the first bolt to secure the first positioning component in first fixed position on the foot; and the second positioning component comprises a second nut that engages the second bolt to secure the second positioning component in a second fixed position on the foot.

10. A foot assembly for mounting an antenna mast, the foot assembly comprising:

a foot comprising:

a first sidewall flange terminating at a first distal section;

a first slot formed within the first distal section;

a second sidewall flange terminating at a second distal section, the second sidewall flange opposing the first sidewall flange; and a second slot formed within the second distal section, the second slot opposing and aligned with the first slot;

a first positioning component coupled between the first sidewall flange and the second sidewall flange and configured for sliding movement within the first slot and the second slot, and the first positioning component configured to bear upon a first external side of the antenna mast;

a second positioning component coupled between the first sidewall flange and the second sidewall flange and configured for sliding movement within the first slot and the second slot, and the second positioning component configured to bear upon a second external side of the antenna mast; and an adjustment assembly coupled to the first positioning component and the second positioning component, the adjustment assembly configured to adjust spacing between the first positioning component and the second positioning component.

11. The foot assembly of claim 10, wherein:

the first positioning component and the second positioning component are configured to flank the antenna mast; and the spacing between the first positioning component and the second positioning component influences a mounting angle of the antenna mast relative to the foot.

12. The foot assembly of claim 10, further comprising a coupling element extending between the first sidewall flange and the second sidewall flange, the coupling element configured to couple a proximal end of the antenna mast to the foot such that the antenna mast is pivotable relative to the foot.

13. The foot assembly of claim 10, wherein:

the first positioning component comprises a first sleeve bushing located between the first sidewall flange and the second sidewall flange, and a first bolt inserted through the first slot, the first sleeve bushing, and the second slot;

the second positioning component comprises a second sleeve bushing located between the first sidewall flange and the second sidewall flange, and a second bolt inserted through the first slot, the second sleeve bushing, and the second slot; and the adjustment assembly is coupled to the first sleeve bushing and the second sleeve bushing.

14. The foot assembly of claim 13, wherein:

the first sleeve bushing comprises a first boss having an unthreaded through hole formed therein;

the second sleeve bushing comprises a second boss having a threaded through hole formed therein; and the adjustment assembly further comprises an adjustment bolt positioned in the unthreaded through hole and engaged with the threaded through hole, wherein rotation of the adjustment bolt adjusts the spacing between the first positioning component and the second positioning component.

15. The foot assembly of claim 14, wherein:

the first sleeve bushing has a first major longitudinal axis that is orthogonal to the adjustment bolt; and the second sleeve bushing has a second major longitudinal axis that is orthogonal to the adjustment bolt.

16. The foot assembly of claim 13, wherein:

the first positioning component comprises a first nut that engages the first bolt to secure the first sleeve bushing in first fixed position on the foot; and the second positioning component comprises a second nut that engages the second bolt to secure the second sleeve bushing in a second fixed position on the foot.

17. A mounting assembly for an antenna, the mounting assembly comprising:

a foot comprising:

a base configured to be attached to a mounting structure;

a first sidewall flange extending from the base, the first sidewall flange having a first slot formed therein; and a second sidewall flange extending from the base, the second sidewall flange opposing the first sidewall flange and having a second slot formed therein;

an antenna mast having a proximal end pivotally coupled to the foot between the first sidewall flange and the second sidewall flange;

a first mast positioning component coupled between the first sidewall flange and the second sidewall flange and movable within the first slot and the second slot, the first mast positioning component providing a first adjustable support structure for a first external side of the antenna mast; and a second mast positioning component coupled between the first sidewall flange and the second sidewall flange and movable within the first slot and the second slot, the second mast positioning component providing a second adjustable support structure for a second external side of the antenna mast.

18. The mounting assembly of claim 17, further comprising an adjustment assembly coupled to the first mast positioning component and the second mast positioning component, the adjustment assembly configured to adjust a mounting angle of the antenna mast relative to the foot by changing spacing between the first positioning component and the second positioning component.

19. The mounting assembly of claim 18, wherein:

the first mast positioning component comprises a first sleeve bushing located between the first sidewall flange and the second sidewall flange, and a first bolt inserted through the first slot, through the first sleeve bushing, and through the second slot;

the second mast positioning component comprises a second sleeve bushing located between the first sidewall flange and the second sidewall flange, and a second bolt inserted through the first slot, through the second sleeve bushing, and through the second slot; and the adjustment assembly is coupled to the first sleeve bushing and the second sleeve bushing.

* * * * *